US009761209B2

(12) United States Patent
Cook et al.

(10) Patent No.: US 9,761,209 B2
(45) Date of Patent: Sep. 12, 2017

(54) SYNTHETIC MUSICAL INSTRUMENT WITH TOUCH DYNAMICS AND/OR EXPRESSIVENESS CONTROL

(71) Applicant: SMULE, INC., San Francisco, CA (US)

(72) Inventors: Perry R. Cook, Jacksonville, OR (US); Jeannie Yang, San Francisco, CA (US); Yuning Woo, San Francisco, CA (US); John Shimmin, San Francisco, CA (US); Randal Leistikow, Denver, CO (US); Michael Berger, Redwood City, CA (US); Jeff Smith, San Francisco, CA (US)

(73) Assignee: Smule, Inc., San Francisco, CA (US)

( * ) Notice: Subject to any disclaimer, the term of this patent is extended or adjusted under 35 U.S.C. 154(b) by 0 days.

(21) Appl. No.: 15/275,807

(22) Filed: Sep. 26, 2016

(65) Prior Publication Data

US 2017/0011724 A1 Jan. 12, 2017

Related U.S. Application Data

(63) Continuation-in-part of application No. 14/797,695, filed on Jul. 13, 2015, now Pat. No. 9,620,095, which
(Continued)

(51) Int. Cl.
*G10H 1/00* (2006.01)
*G10H 1/18* (2006.01)
(Continued)

(52) U.S. Cl.
CPC ..... *G10H 1/0016* (2013.01); *G10H 1/368* (2013.01); *G10H 1/38* (2013.01);
(Continued)

(58) Field of Classification Search
CPC ..... G10H 1/0016; G10H 1/368; G10H 1/38; G10H 2210/091; G10H 2210/201;
(Continued)

(56) References Cited

U.S. PATENT DOCUMENTS 8,222,507 B1 * 7/2012 Salazar ..... G10H 1/0008 84/602
8,772,621 B2 7/2014 Wang et al.
(Continued)

FOREIGN PATENT DOCUMENTS

KR 10-0294603 B1 11/2001
KR 10-2005-0117808 A 12/2005

OTHER PUBLICATIONS

Gaye, L. et al., "Mobile music technology: Report on an emerging community", Proceedings of the International Conference on New Interfaces for Musical Expression, pp. 22-25, Paris, France, 2006.
(Continued)

*Primary Examiner* — Jeffrey Donels
(74) *Attorney, Agent, or Firm* — Haynes and Boone, LLP

(57) ABSTRACT

Notwithstanding practical limitations imposed by mobile device platforms and applications, truly captivating musical instruments may be synthesized in ways that allow musically expressive performances to be captured and rendered in real-time. Synthetic musical instruments that provide a game, grading or instructional mode are described in which one or more qualities of a user's performance are assessed relative to a musical score. By providing a range of modes (from score-assisted to fully user-expressive), user interactions with synthetic musical instruments are made more engaging and tend to capture user interest over generally longer periods of time. Synthetic musical instruments are described in which force dynamics of user gestures (such as finger contact forces applied to a multi-touch sensitive display or surface and/or the temporal extent and applied
(Continued)

pressure of sustained contact thereon) are captured and drive the digital synthesis in ways that enhance expressiveness of user performances.

36 Claims, 7 Drawing Sheets

Related U.S. Application Data is a continuation of application No. 13/664,939, filed on Oct. 31, 2012, now Pat. No. 9,082,380.

(60) Provisional application No. 61/553,781, filed on Oct. 31, 2011, provisional application No. 62/222,824, filed on Sep. 24, 2015.

(51) Int. Cl.
*G10H 7/00* (2006.01)
*G10H 1/36* (2006.01)
*G10H 1/38* (2006.01)

(52) U.S. Cl.
CPC . *G10H 2210/091* (2013.01); *G10H 2210/201* (2013.01); *G10H 2210/225* (2013.01); *G10H 2220/096* (2013.01); *G10H 2220/241* (2013.01); *G10H 2220/355* (2013.01); *G10H 2220/395* (2013.01)

(58) Field of Classification Search
CPC ..... G10H 2210/225; G10H 2220/096; G10H 2220/241; G10H 2220/355; G10H 2220/395
USPC ..... 84/615
See application file for complete search history.

(56) References Cited

U.S. PATENT DOCUMENTS

| | | | | |
|---|---|---|---|---|
| 9,082,380 | B1 * | 7/2015 | Hamilton | G10H 1/368 |
| 9,620,095 | B1 * | 4/2017 | Hamilton | G10H 1/368 |
| 2011/0134061 | A1 | 6/2011 | Lim | |
| 2012/0174736 | A1 * | 7/2012 | Wang | G10H 1/0008 84/622 |
| 2012/0186416 | A1 | 7/2012 | Souppa et al. | |
| 2013/0180385 | A1 * | 7/2013 | Hamilton | G10H 1/0016 84/603 |
| 2014/0047970 | A1 | 2/2014 | Yoshikawa et al. | |
| 2014/0349761 | A1 * | 11/2014 | Kruge | A63F 13/426 463/35 |

OTHER PUBLICATIONS

G. Wang et al., "MoPhO: Do Mobile Phones Dream of Electric Orchestras?" In Proceedings of the International Computer Music Conference, Belfast, Aug. 2008.

Jason Snell, "Best 3D Touch Apps for the iPhone 6s and 6s Plus", Nov. 6, 2015 (retrieved Sep. 26, 2016), Tom's Guide, pp. 1-15, http://www.tomsguide.com/.

PCT International Search Report /Written Opinion of International Search Authority for counterpart application, mailed Jan. 10, 2017, of PCT/US2016/053731.

* cited by examiner

SYNTHETIC MUSICAL INSTRUMENT WITH TOUCH DYNAMICS AND/OR EXPRESSIVENESS CONTROL

CROSS-REFERENCE

The present application claims priority of U.S. Provisional Application No. 62/222,824, filed Sep. 24, 2015. The present application is also a continuation-in-part of U.S. patent application Ser. No. 14/797,695, filed on Jul. 13, 2015, which is a continuation of U.S. patent application Ser. No. 13/664,939, filed Oct. 31, 2012, now U.S. Pat. No. 9,082,380, which in-turn claims priority of U.S. Provisional Application No. 61/553,781, filed Oct. 31, 2011. Each of the foregoing applications is incorporated herein by reference.

BACKGROUND

Field of the Invention

The invention relates generally to musical instruments and, in particular, to techniques suitable for use in portable device hosted implementations of musical instruments for capture and rendering of musical performances with gameplay features.

Related Art

The proliferation of mobile, indeed social, music technology presents opportunities for increasingly sophisticated, yet widely deployable, tools for musical composition and performance. See generally, L. Gaye, L. E. Holmquist, F. Behrendt, and A. Tanaka, "Mobile music technology: Report on an emerging community" in *Proceedings of the International Conference on New Interfaces for Musical Expression*, pages 22-25, Paris, France (2006); see also, G. Wang, G. Essl, and H. Penttinen, "Do Mobile Phones Dream of Electric Orchestras?" in *Proceedings of the International Computer Music Conference*, Belfast (2008). Indeed, applications such as the Smule Ocarina™, Leaf Trombone®, I Am T-Pain™, AutoRap®, Sing! Karaoke™, Guitar! By Smule®, and Magic Piano® apps available from Smule, Inc. have shown that advanced digital acoustic techniques may be delivered on iPhone®, iPad®, iPod Touch® and other iOS® or Android devices in ways that provide users and listeners alike with compelling musical experiences.

As mobile music technology matures and as new social networking and monetization paradigms emerge, improved techniques and solutions are desired that build on well understood musical interaction paradigms but unlock new opportunities for musical composition, performance and collaboration amongst a new generation of artists using a new generation of audiovisual capable devices and compute platforms.

SUMMARY

Despite practical limitations imposed by mobile device platforms and applications, truly captivating musical instruments may be synthesized in ways that allow musically expressive performances to be captured and rendered in real-time. In some cases, synthetic musical instruments can provide a game, grading or instructional mode in which one or more qualities of a user's performance are assessed relative to a musical score. By providing a range of modes (from score-assisted to fully user-expressive) and, in some cases, by adapting to the level of a given user musician's skill, user interactions with synthetic musical instruments can be made more engaging and may capture user interest over generally longer periods of time. Indeed, as economics of application software markets (at least those for portable handheld device type software popularized by Apple's iTunes Store for Apps and the Google Play! Android marketplace) transition from initial purchase price revenue models to longer term and recurring monetization strategies, such as through in-app purchases and/or subscriptions, user and group affinity characterization and social networking ties, importance of long term user engagement with an application or suite is increasing.

To those ends, techniques have been developed to tailor and adapt the user musician experience and to maintain long term engagement with apps and app suites. Some of those techniques can be realized in synthetic musical instrument implementations in which captured dynamics of user gestures (such as finger contact forces applied to a multi-touch sensitive display or surface and/or the temporal extent of sustained contact thereon) convey to the digital synthesis expressive aspects of a user's performance. Performance adaptive tempos may also be supported in some cases. Responsiveness of the digital synthesis to captured dynamics may be based a self-reported level of musical skill or that observable by the synthetic musical instrument or related computational facilities. In this way, amateur and expert users can be provided with very different, but appropriately engaging, user experiences. Similarly, a given user's experience can be adapted as the user's skill level improves.

More specifically, aspects of these performance- and/or skill-adaptive techniques have been concretely realized in synthetic musical instrument applications that are responsive to force touch dynamics of user digit (finger or thumb) contacts. These and other realizations will be understood in the context of specific implementations and teaching examples that follow, including those that pertain to synthetic piano- or keyboard-type musical instrument application software suitable for execution on a portable handheld computing devices of the type popularized by iOS and Android smartphones and pad/tablet devices. In some exemplary implementations, visual cues presented on a multi-touch sensitive display provide the user with temporally sequenced note and chord selections throughout a performance in accordance with the musical score. Note soundings are indicated by user gestures captured at the multi-touch sensitive display and may include measures of contact forces applied to the multi-touch sensitive display. In some cases, forces may be quantified by force responsive elements of the display itself. In some cases, auxiliary measurements, such as using an onboard accelerometer, may be employed. One or more measures of correspondence between actual note soundings (including finger or thumb contact dynamics) with a score-coded temporal sequence of notes (including onset, velocity and/or sustain attributes thereof) and chord selections are used to grade the user's performance.

In general, both visual cuing and note sounding gestures may be particular to the synthetic musical instrument implemented. For example, in a piano configuration or embodiment reminiscent of that popularized by Smule, Inc. in its Magic Piano application for iPad, iPhone and Android devices, user digit contacts (i.e., finger and/or thumb contacts, referred to hereinafter simply as "finger contacts") at laterally displaced positions on the multi-touch sensitive display constitute gestures indicative of key strikes, and a digital synthesis of a piano is used to render an audible performance in correspondence with captured user gestures. By using a multi-touch sensitive display that is responsive to the level pressure or force applied (such as in Force Touch or 3D Touch enabled displays), multiple dimensions of users expressed note sounding gestures may be captured and conveyed to the digital synthesis of piano key strikes. A piano roll style set of visual cues provides the user with note and chord selections. In some cases, desired note velocity and/or sustained after-touch expressions of a performance may also visually cued. While the visual cues are driven by a musical score and revealed/advanced at a current performance tempo, it is the user's gestures that actually drive the audible performance rendering. Given this decoupling, the user's performance (as captured and audibly rendered) often diverges (in note velocity, note onset, sustained after-touch and/or tempo) from a precise score-coded version and/or visual cues based thereon. These divergences, particularly divergences from musically scored note velocity, sustained after-touch and tempo, can be expressive or simply errant.

As will be appreciated, pleasing musical performances are generally not contingent upon performing to an strict set of note velocities, sustains and/or tempo(s) as musically scored. Rather, variations in tempo are commonly used as intentional musical artifacts by performers, speeding up or slowing down phrases or individual notes to add emphasis. Likewise with sounded (or voiced) note velocity, note sustain, or after-touch key pressure. Indeed, these modulations in tempo (onset and sustain) as well as note velocity and/or after-touch (or post-onset key pressure) are often described as "expressiveness." Techniques described herein aim to allow users to be expressive while remaining, generally speaking, rhythmically and otherwise consistent with the musical score.

Accordingly, techniques have been developed to support user expressivity by mapping force-quantified (or force-estimated) aspects of user expressed note sounding gestures captured at multi-touch sensitive display to musically expressive parameters such as sounded note velocity or after-touch key pressure. Such musically expressive parameters are, in turn, supplied to the digital synthesis in a Magic Piano type instrument. By conveying these newly captured (or capturable) parameters of note sounding gestural expression to the digital synthesis, it is possible for a synthetic music instrument implemented on a portable computing device to support greater levels of user expression.

In addition, selective override or modulation of existing expressive parameters represented in a MIDI-encoded score file may be provided. In some cases or embodiments, the degree of override or modulation of one or more score coded parameters such as sounded note velocity, sustain or after-touch key pressure may be design choice or mode setting. In other cases or embodiments, the degree of override or modulation may be exposed by a user interface of the synthetic music instrument. For example, an expression slider (or rotary knob, or even a set of buttons) may be provided as a user interface element to allow the user to decide how much expressive control they want. In this way, a no (or low) expression setting may provide an operating mode in which notes are visually cued based on score-coded note "on" timing, but actually sounded based on user gestures, though with note velocity (loudness/timbre) and duration (note-off time) determined by the score. On the other hand, a full expression setting may place note velocity and note sustain under user control of the user based on captured dynamics of finger contact (e.g., measured or estimated striking contact force and after-touch pressure). Between the extremes, intermediate levels of expression may be selected such that half way would allow user expressed finger contact dynamics to influence the score coded dynamics, a quarter way would be mostly score, while three quarters would be mostly user expression. Linear or other "parameter cross-fade" curves can be used, depending on the function being controlled.

Typically, visual cues are supplied for score-coded notes in a manner that suggests to a user a timing (start time) for expressing a note sounding gesture. In some cases or embodiments, visual cues may be selected to also suggest to a user note velocity (loudness/timbre), duration or sustain (note-off time), and/or after-touch pressure. In such cases, correspondence of a user's actual performance with cued note velocity, sustain or after-touch may be measured as part of performance evaluation, grading or gameplay.

Techniques have likewise been developed to optionally and adaptively adjust a current value of target tempo against which timings of successive note or chord soundings are evaluated or graded. Tempo adaptation is based on actual tempo of the user's performance and, in some embodiments, includes filtering or averaging over multiple successive note soundings with suitable non-linearities (e.g., dead band(s), rate of change limiters or caps, hysteresis, etc.) in the computational implementation. In some cases, changes to the extent and parameterization of filtering or averaging windows may themselves be coded in correspondence with the musical score. In any case, by repeatedly recalculating the current value for target tempo throughout the course of the user's performance, both the pace of success visual cues and the temporal baseline against which successive user note/chord sounding are evaluated or graded may be varied.

In this way, expressive accelerations and decelerations of performance tempo are tolerated in the performance evaluation/grading and are adapted-to in the supply of successive note/chord sounding visual cues. Discrimination between expressive and merely errant/random divergences from a current target tempo may be based on consistency of the tempo over a filtering or averaging window. In some cases, expressive accelerations and decelerations of performance tempo may not only be tolerated, but may themselves contribute as a quality metric to the evaluation or grading of a user's performance.

In general, audible rendering includes synthesis of tones, overtones, harmonics, perturbations and amplitudes and other performance characteristics based on the captured gesture stream. In some cases, rendering of the performance includes audible rendering by converting to acoustic energy a signal synthesized from the gesture stream encoding (e.g., by driving a speaker). In some cases, the audible rendering is on the very device on which the musical performance is captured. In some cases, the gesture stream encoding is conveyed to a remote device whereupon audible rendering converts a synthesized signal to acoustic energy.

Thus, in some embodiments, a synthetic musical instrument (such as a synthetic piano, guitar or trombone) allows the human user to control a parameterized synthesis or, in some cases, an actual expressive model of a vibrating string or resonating column of air, using multi-sensor interactions (key strikes, fingers on strings or at frets, strumming covering of holes, etc.) via a multi-touch sensitive display. The user is actually causing the sound and controlling the parameters affecting pitch, quality, etc.

In some embodiments, a storybook mode provides lesson plans which teach the user to play the synthetic instrument and exercise. User performances may be graded (or scored) as part of a game (or social-competitive application framework), and/or as a proficiency measure for advancement from one stage of a lesson plan to the next. In general, better performance lets the player (or pupil) advance faster. High scores both encourage the pupil (user) and allow the system to know how quickly to advance the user to the next level and, in some cases, along which game or instructive pathway. In each case, the user is playing a real/virtual model of an instrument, and their gestures actually control the sound, timing, etc.

Often, both the device on which a performance is captured and that on which the corresponding gesture stream encoding is rendered are portable, even handheld devices, such as pads, mobile phones, personal digital assistants, smart phones, media players, or book readers. In some cases, rendering is to a conventional audio encoding such as AAC, MP3, etc. In some cases, rendering to an audio encoding format is performed on a computational system with substantial processing and storage facilities, such as a server on which appropriate CODECs may operate and from which content may thereafter be served. Often, the same gesture stream encoding of a performance may (i) support local audible rendering on the capture device, (ii) be transmitted for audible rendering on one or more remote devices that execute a digital synthesis of the musical instrument and/or (iii) be rendered to an audio encoding format to support conventional streaming or download.

In some embodiments in accordance with the present invention(s), a method includes using a portable computing device as a synthetic musical instrument, presenting a user of the synthetic musical instrument with visual cues on a multi-touch sensitive display of the portable computing device, capturing note sounding gestures indicated by the user based on finger contacts with the multi-touch sensitive display, and audibly rendering a performance on the portable computing device in real-time correspondence with the captured note sounding gestures, including the finger contact dynamics thereof. The presented visual cues are indicative of temporally sequenced note selections in accord with a musical score. Individual ones of the captured note sounding gestures are characterized, at least in part, based on position and dynamics of finger contact with the multi-touch sensitive display.

In some cases or embodiments, the finger contact dynamics include a characterization of finger contact force applied to the multi-touch sensitive display, and the characterization of finger contact force is used as at least a contributing indicator for velocity with which a corresponding note is sounded in the audibly rendered performance. In some embodiments, for member notes of a chord sounded in the audibly rendered performance, the method further includes applying a generally uniform velocity based on the characterization of at least one corresponding finger contact force. In some embodiments, for member notes of a chord sounded in the audibly rendered performance, the method further includes applying individual velocities based, at least in part, on characterizations of respective finger contact forces.

In some cases or embodiments, the finger contact force is characterized at the portable computing device based on sensitivity of the multi-touch sensitive display itself to a range of applied force magnitudes. In some cases or embodiments, the characterization of finger contact force includes a remapping from a multi-touch sensitive display contact force data domain to a mapped range of note velocities for the synthetic musical instrument. In some cases or embodiments, the synthetic musical instrument includes a piano or keyboard, and the remapping is in accord with a normalized half-sigmoidal-type mapping function.

In some cases or embodiments, the finger contact force is characterized at the portable computing device based on accelerometer data associable with the finger contact. In some cases or embodiments, the finger contact dynamics further include both onset and release of a finger contact. A temporal extent of the finger contact, from onset to release, is used as at least a contributing indicator for sustaining of a corresponding note sounded in the audibly rendered performance. In some cases or embodiments, the finger contact dynamics further include after-touch dynamics used as at least for vibrato or bend of a corresponding note sounded in the audibly rendered performance.

In some embodiments wherein the musical score encodes a temporal sequencing of note selections together with corresponding dynamics, the method further includes: (1) for at least a subset of the captured note sounding gestures, computing effective note sounding dynamics based, for a given note sounding gesture, on both: the score-coded dynamics for the corresponding note selection and user-expressed dynamics of finger contact with the multi-touch sensitive display, and (2) audibly rendering the performance on the portable computing device in real-time correspondence with the captured note sounding gestures based on the computed effective note sounding dynamics.

In some embodiments, the method further includes computing the effective note sounding dynamics as a function that includes a weighed sum of the score-coded and user-expressed dynamics. In some cases or embodiments, the weighed sum includes an approximately 25% contribution in accord with score-coded note velocities and an approximately 75% contribution in accord user-expressed note sounding velocity characterized based on finger contact forces applied to the multi-touch sensitive display. In some embodiments, the method further includes varying comparative contributions of score-coded dynamics and user-expressed dynamics to the computed effective note sounding dynamics based on a user interface control.

In some cases or embodiments, the user interface control is provided at least in part, using a slider, knob or selector visually presented on the multi-touch sensitive display. The user interface control provides either or both of: a predetermined set of values for the comparative contributions and an effectively continuous variation of the comparative contributions. In some embodiments, the method further includes dynamically varying the comparative contributions.

In some embodiments, the method further includes dynamically varying (based on the musical score) during a course of the performance comparative contributions of score-coded dynamics and user-expressed dynamics to the computed effective note sounding dynamics. In some embodiments, the method further computing the effective note sounding dynamics as a function that modulates score-coded note velocities based on characterization of user-expressed finger contact forces applied to the multi-touch sensitive display in connection with the particular note sounding gestures.

In some cases or embodiments, the presentation of visual cues is in correspondence with a target tempo. The method further includes repeatedly recalculating a current value for the target tempo throughout the performance by the user and thereby varying, at least partially in correspondence with an actual performance tempo indicated by the captured note sounding gestures, a pace at which visual cues for successive ones of the note selections arrive at a sounding zone of the multi-touch sensitive display. In some cases or embodiments, the repeatedly recalculating includes, for at least a subset of successive note sounding gestures: computing a distance from an expected sounding of the corresponding visually cued note selection and updating the current value for the target tempo based on a function of the computed distance.

In some embodiments, the method further includes determining correspondence of respective captured note sounding gestures with the visual cues and grading the user's performance based on the determined correspondences. In some embodiments, the method further includes presenting the user with visual cues indicative of score-coded note velocities, wherein the determined correspondences include correspondence of score-coded note velocities with note velocities actually expressed by the users note sounding gestures. In some cases or embodiments, the determined correspondences includes one or more of: (i) a measure of temporal correspondence of a particular note sounding gesture with arrival of a visual cue in a sounding zone, (ii) a measure of note selection correspondence of the particular note sounding gesture with the visual cue, and (iii) a measure of correspondence of finger contact dynamics for particular note sounding gesture with visually cued note velocity.

In some cases or embodiments, the presented visual cues traverse at least a portion of the multi-touch sensitive display toward a sounding zone. In some cases or embodiments, the synthetic musical instrument is a piano or keyboard, and the visual cues travel across the multi-touch sensitive display and represent, in one dimension of the multi-touch sensitive display, desired key contacts in accordance with notes of the score and, in a second dimension generally orthogonal to the first, temporal sequencing of the desired key contacts. In some cases or embodiments, the synthetic musical instrument is a string instrument, and the visual cues code, in one dimension of the multi-touch sensitive display, desired contact with corresponding ones of the strings in accordance with the score and, in a second dimension generally orthogonal to the first, temporal sequencing of the desired contacts paced in accord with the current value of the target tempo. In some cases or embodiments, the captured note sounding gestures are indicative of both string excitation and pitch selection for the excited string.

In some embodiments, the method further includes presenting on the multi-touch sensitive display a lesson plan of exercises, wherein the captured note selection gestures correspond to performance by the user of a particular one of the exercises, and advancing the user to a next exercise of the lesson plan based on a grading of the user's performance of the particular exercise.

In some cases or embodiments, the portable computing device includes a communications interface and the method further includes transmitting an encoded stream of the note sounding gestures via the communications interface for rendering of the performance on a remote device.

In some cases or embodiments, the audible rendering includes: modeling acoustic response for one of a piano, a guitar, a violin, a viola, a cello, a double bass, organ(s) and a accordion, and driving the modeled acoustic response with inputs corresponding to the captured note sounding gestures and, for at least some of the captured note sounding gestures, a combination of score-coded and user-expressed dynamics. In some cases or embodiments, the portable computing device is selected from the group of: a compute pad; a personal digital assistant or book reader; and a mobile phone or media player.

In some embodiments, the method further includes geocoding the transmitted gesture stream and displaying a geographic origin for, and in correspondence with audible rendering of, another user's performance encoded as another stream of notes sounding gestures received via the communications interface directly or indirectly from a remote device.

In some embodiments in accordance with the present invention, a method includes using a portable computing device as a synthetic musical instrument; presenting a user of the synthetic musical instrument with visual cues on a multi-touch sensitive display of the portable computing device, the presented visual cues indicative of temporally sequenced note selections in accord with a musical score, wherein the musical score further encodes dynamics for at least some of the note selections; capturing note sounding gestures indicated by the user based on finger contacts with the multi-touch sensitive display, wherein individual ones of the captured note sounding gestures are characterized, at least in part, based on position and dynamics of finger contact with the multi-touch sensitive display; for at least a subset of the captured note sounding gestures, computing effective note sounding dynamics based, for a given note sounding gesture, on both the score-coded dynamics for the corresponding note selection and user-expressed dynamics of finger contact with the multi-touch sensitive display; and audibly rendering the performance on the portable computing device in real-time correspondence with the captured note sounding gestures based on the computed effective note sounding dynamics.

In some embodiments, the method further includes computing the effective note sounding dynamics as a function that includes a weighed sum of the score-coded and user-expressed dynamics. In some cases or embodiments, the weighed sum includes an approximately 25% contribution in accord with score-coded note velocities and an approximately 75% contribution in accord user-expressed note sounding velocity characterized based on finger contact forces applied to the multi-touch sensitive display.

In some embodiments, the method further includes varying comparative contributions of score-coded dynamics and user-expressed dynamics to the computed effective note sounding dynamics based on a user interface control. In some cases or embodiments, the user interface control is provided at least in part, using a slider, knob or selector visually presented on the multi-touch sensitive display. The user interface control provides either or both of: a predetermined set of values for the comparative contributions and an effectively continuous variation of the comparative contributions. In some embodiments, the method further includes dynamically varying the comparative contributions.

In some embodiments, the method further includes dynamically varying (based on the musical score) during a course of the performance comparative contributions of score-coded dynamics and user-expressed dynamics to the computed effective note sounding dynamics.

In some embodiments, the method further includes computing the effective note sounding dynamics as a function that modulates score-coded note velocities based on characterization of user-expressed finger contact forces applied to the multi-touch sensitive display in connection with the particular note sounding gestures.

In some cases or embodiments, the finger contact dynamics include a characterization of finger contact force applied to the multi-touch sensitive display, and the characterization of finger contact force is used as at least a contributing indicator for velocity with which a corresponding note is sounded in the audibly rendered performance. In some embodiments, for member notes of a chord sounded in the audibly rendered performance, the method further includes applying a generally uniform velocity based on the characterization of at least one corresponding finger contact force. In some embodiments, for member notes of a chord sounded in the audibly rendered performance, the method further includes applying individual velocities based, at least in part, on characterizations of respective finger contact forces.

In some cases or embodiments, the finger contact force is characterized at the portable computing device based on sensitivity of the multi-touch sensitive display itself to a range of applied force magnitudes. In some cases or embodiments, the characterization of finger contact force includes a remapping from a multi-touch sensitive display contact force data domain to a mapped range of note velocities for the synthetic musical instrument. In some cases or embodiments, the synthetic musical instrument includes a piano or keyboard and the remapping is in accord with a normalized half-sigmoidal-type mapping function. In some cases or embodiments, the remapping is in accord with a cosine, exponential, log, raised cosine or arctangent-type mapping function.

In some cases or embodiments, the finger contact force is characterized at the portable computing device based on accelerometer data associable with the finger contact. In some embodiments, the method further includes determining correspondence of respective captured note sounding gestures with the visual cues and grading the user's performance based on the determined correspondences. In some embodiments, the method further includes presenting the user with visual cues indicative of score-coded note velocities, wherein the determined correspondences include correspondence of score-coded note velocities with note velocities actually expressed by the users note sounding gestures.

In some cases or embodiments, the determined correspondences includes one or more of: (i) a measure of temporal correspondence of a particular note sounding gesture with arrival of a visual cue in a sounding zone, (ii) a measure of note selection correspondence of the particular note sounding gesture with the visual cue, and (iii) a measure of correspondence of finger contact dynamics for particular note sounding gesture with visually cued note velocity.

In some cases or embodiments, the presented visual cues traverse at least a portion of the multi-touch sensitive display toward a sounding zone. In some cases or embodiments, the synthetic musical instrument is a piano or keyboard. The visual cues travel across the multi-touch sensitive display and represent, in one dimension of the multi-touch sensitive display, desired key contacts in accordance with notes of the score and, in a second dimension generally orthogonal to the first, temporal sequencing of the desired key contacts. In some cases or embodiments, the synthetic musical instrument is a string instrument, and the visual cues code, in one dimension of the multi-touch sensitive display, desired contact with corresponding ones of the strings in accordance with the score and, in a second dimension generally orthogonal to the first, temporal sequencing of the desired contacts paced in accord with the current value of the target tempo. In some cases or embodiments, the captured note sounding gestures are indicative of both string excitation and pitch selection for the excited string.

In some embodiments, the method further includes presenting on the multi-touch sensitive display a lesson plan of exercises, wherein the captured note selection gestures correspond to performance by the user of a particular one of the exercises; and advancing the user to a next exercise of the lesson plan based on a grading In some cases or embodiments, the portable computing device includes a communications interface, and the method further includes transmitting an encoded stream of the note sounding gestures via the communications interface for rendering of the performance on a remote device.

In some cases or embodiments, the audible rendering includes: modeling acoustic response for one of a piano, a guitar, a violin, a viola, a cello and a double bass; and driving the modeled acoustic response with inputs corresponding to the captured note sounding gestures and, for at least some of the captured note sounding gestures, a combination of score-coded and user-expressed dynamics.

In some embodiments, the method further includes geocoding the transmitted gesture stream; and displaying a geographic origin for, and in correspondence with audible rendering of, another user's performance encoded as another stream of notes sounding gestures received via the communications interface directly or indirectly from a remote device.

In some embodiments in accordance with the present invention, an apparatus includes a portable computing device and machine readable code executable thereon. The portable computing device has a multi-touch display interface. The machine readable code is executable on the portable computing device to implement the synthetic musical instrument, the machine readable code including instructions executable to present a user of the synthetic musical instrument with visual cues on a multi-touch sensitive display of the portable computing device, the presented visual cues indicative of temporally sequenced note selections in accord with a musical score, wherein the musical score further encodes dynamics for at least some of the note selections. The machine readable code further executable to (i) capture note sounding gestures indicated by the user based on finger contacts with the multi-touch sensitive display, wherein individual ones of the captured note sounding gestures are characterized, at least in part, based on position and dynamics of finger contact with the multi-touch sensitive display and (ii) for at least a subset of the captured note sounding gestures, to compute effective note sounding dynamics based, for a given note sounding gesture, on both the score-coded dynamics for the corresponding note selection and user-expressed dynamics of finger contact with the multi-touch sensitive display.

In some embodiments, the apparatus further includes machine readable code executable on the portable computing device to audibly render the performance on the portable computing device in real-time correspondence with the captured note sounding gestures based on the computed effective note sounding dynamics.

In some cases or embodiments, the apparatus is embodied as one or more of a compute pad, a handheld mobile device, a mobile phone, a personal digital assistant, a smart phone, a media player and a book reader.

In some embodiments in accordance with the present invention, a computer program product is encoded in media and including instructions executable to implement a synthetic musical instrument on a portable computing device having a multi-touch display interface. The computer program product encodes and includes: (i) instructions executable on the portable computing device to present a user of the synthetic musical instrument with visual cues on the multi-touch sensitive display of the portable computing device, the presented visual cues indicative of temporally sequenced note selections in accord with a musical score, wherein the musical score further encodes dynamics for at least some of the note selections; and instructions executable on the portable computing device to (i) capture note sounding gestures indicated by the user based on finger contacts with the multi-touch sensitive display, wherein individual ones of the captured note sounding gestures are characterized, at least in part, based on position and dynamics of finger contact with the multi-touch sensitive display and (ii) for at least a subset of the captured note sounding gestures, to compute effective note sounding dynamics based, for a given note sounding gesture, on both the score-coded dynamics for the corresponding note selection and user-expressed dynamics of finger contact with the multi-touch sensitive display.

In some embodiments, the computer program product further encodes and includes instructions executable on the portable computing device to audibly render the performance on the portable computing device in real-time correspondence with the captured note sounding gestures based on the computed effective note sounding dynamics. In some cases or embodiments, the media are readable by the portable computing device or readable incident to a computer program product conveying transmission to the portable computing device.

These and other embodiments in accordance with the present invention(s) will be understood with reference to the description herein as well as the drawings and appended claims which follow.

BRIEF DESCRIPTION OF THE DRAWINGS

The present invention is illustrated by way of example and not limitation with reference to the accompanying figures, in which like references generally indicate similar elements or features.

FIG. 1 depicts an individual performance use and FIG. 2 depicts note and chord sequences visually cued in accordance with a musical score.

Skilled artisans will appreciate that elements or features in the figures are illustrated for simplicity and clarity and have not necessarily been drawn to scale. For example, the dimensions or prominence of some of the illustrated elements or features may be exaggerated relative to other elements or features in an effort to help to improve understanding of embodiments of the present invention.

DESCRIPTION

Many aspects of the design and operation of a synthetic musical instrument with touch dynamics and/or expressiveness control will be understood based on the description herein of certain exemplary piano- or keyboard-type implementations and teaching examples. Nonetheless, it will be understood and appreciated based on the present disclosure that variations and adaptations for other instruments are contemplated. Portable computing device implementations and deployments typical of a social music applications for iOS® and Android® devices are emphasized for purposes of concreteness. Score or tablature user interface conventions popularized in the Magic Piano®, Magic Fiddle™, Magic Guitar™, Leaf Trombone: World Stage™ and Ocarina 2 applications (available from Smule Inc.) are likewise emphasized.

While these synthetic keyboard-type, string and even wind instruments and application software implementations provide a concrete and helpful descriptive framework in which to describe aspects of the invented techniques, it will be understood that Applicant's techniques and innovations are not necessarily limited to such instrument types or to the particular user interface designs or conventions (including e.g., musical score presentations, note sounding gestures, visual cuing, sounding zone depictions, etc.) implemented therein. Indeed, persons of ordinary skill in the art having benefit of the present disclosure will appreciate a wide range of variations and adaptations as well as the broad range of applications and implementations consistent with the examples now more completely described.

Exemplary Synthetic Piano-Type Application

Figure 1:
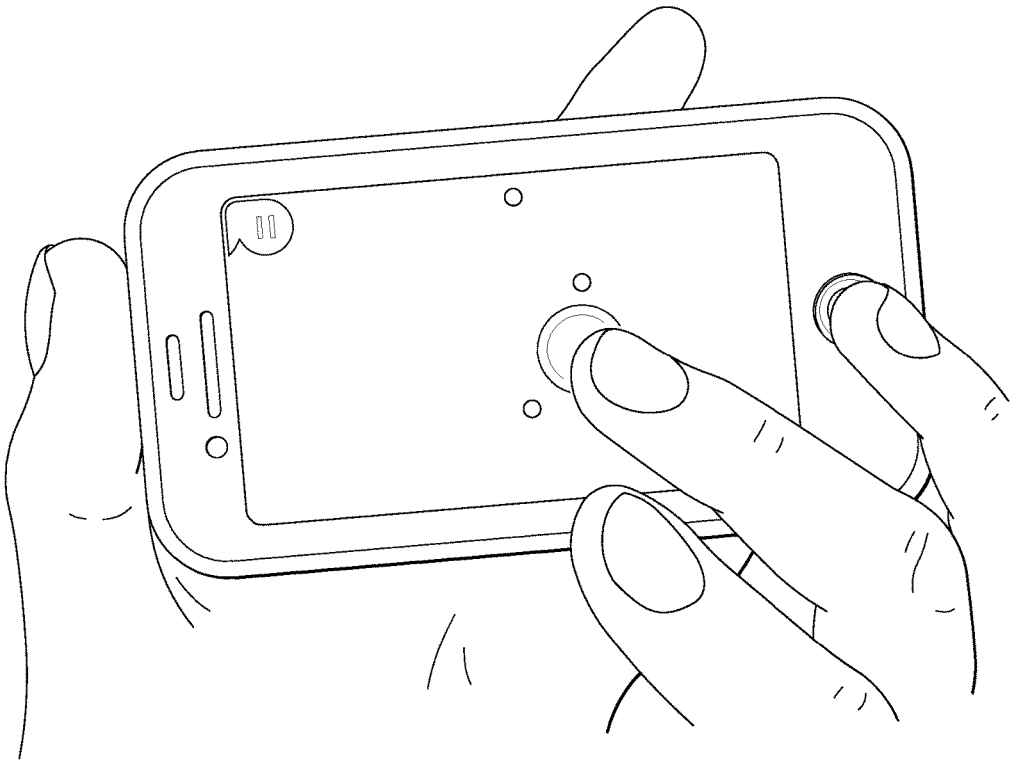
FIGS. 1 and 2 depict performance uses of a portable computing device hosted implementation of a synthetic piano in accordance with some embodiments of the present invention.
Figure 2:
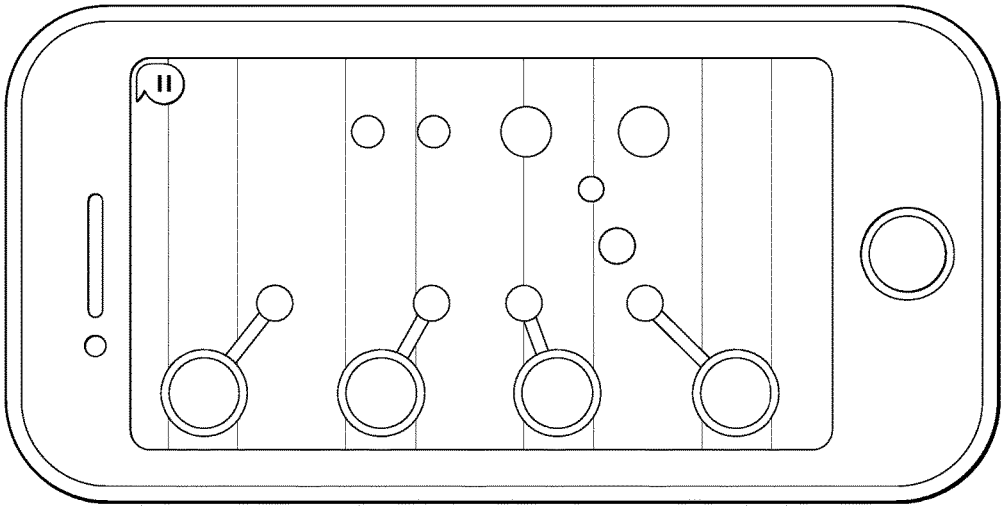

FIGS. 1 and 2 depict performance uses of a portable computing device hosted implementation of a synthetic piano in accordance with some embodiments of the present invention. FIG. 1 depicts an individual performance use and FIG. 2 depicts note and chord sequences visually cued in accordance with a musical score.

Figure 3A:
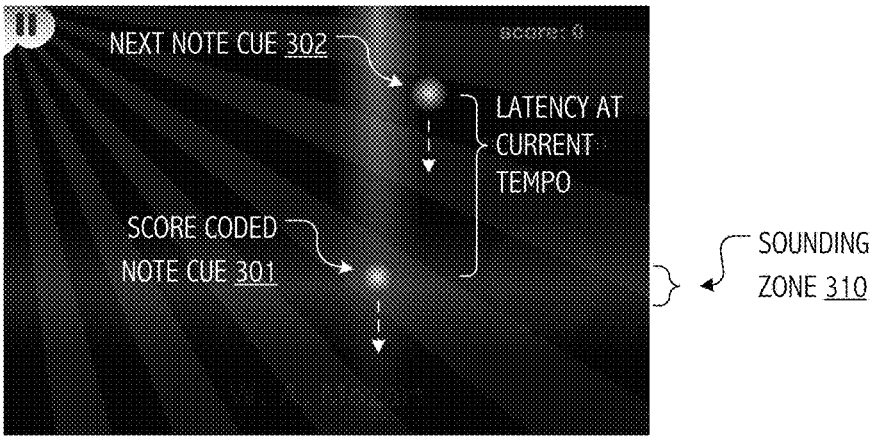
FIGS. 3A, 3B and 3C illustrate spatio-temporal cuing aspects of a user interface design for a synthetic piano instrument in accordance with some embodiments of the present invention.
Figure 3B:
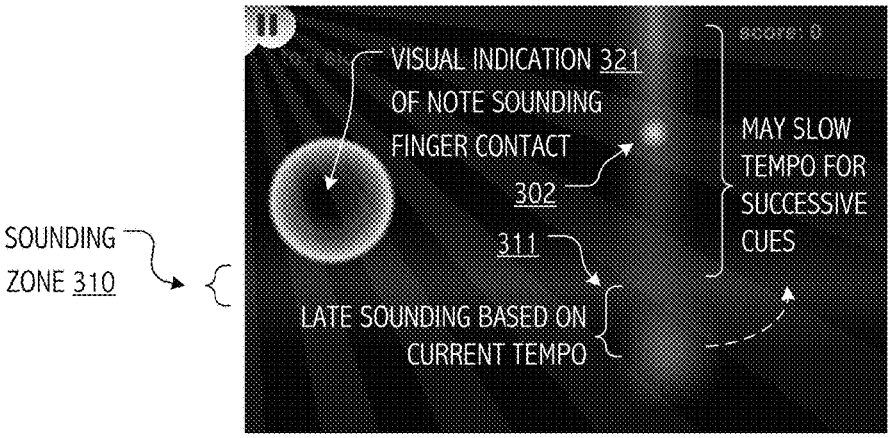
Figure 3C:
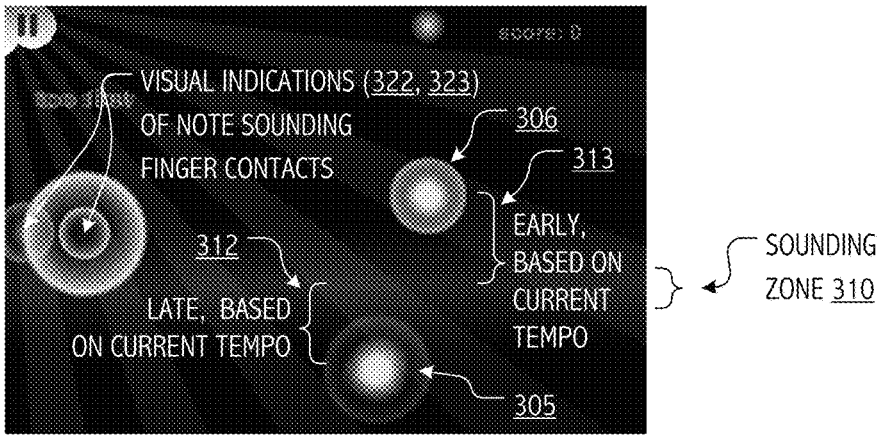

FIGS. 3A, 3B and 3C illustrate spatio-temporal cuing aspects of a user interface design for a synthetic piano instrument in accordance with some embodiments of the present invention. FIG. 3A illustrates a pair of temporally sequenced note cues (301, 302) presented in accord with note/chord selections and meter of an underlying score, as "fireflies" that descend at a rate that corresponds with a current target tempo. In the screen image of FIG. 3A, one of the note cues (note cue 301) appears in a sounding zone 310, suggesting to the user musician, that (based on the current target tempo) the corresponding note is to be sounded by finger contact indicative of a key strike. FIGS. 3B and 3C, which follow, illustrate temporal dynamics of the user interface as well as certain use cases typical of embodiments in which an adaptive tempo facility is provided or enabled. For avoidance of doubt, adaptive tempo may, but need not, be provided in embodiments in accordance with the present invention(s).

FIG. 3B illustrates late sounding (by key strike indicative finger contact by the user musician) of a visually cued note. Thus, the user musician's note sounding gesture (here, a key strike gesture indicated by finger contact with a touch screen of a portable computing device) temporally lags the expected sounding of the score-coded and visually cued (301) note. Note that positioning of visual indication 321 in the screen depiction of FIG. 3B is somewhat arbitrary for purposes of illustration, but in some embodiments may correspond to a touch screen position (or at least a pitch selective lateral position) at which contact is made. In any case, the distance (e.g., a temporal distance or a vertical on-screen distance normalizable thereto) 311 by which the user musician's note sounding lags expected sounding (based on current tempo and score coded meter) may be used (in at least some circumstances described herein) to adapt the rate (here slowing such rate) at which successive note cues are supplied and visually advanced. Thus, and in accord with tempo recalculation techniques described in commonly-owned U.S. Pat. No. 9,082,380, which is incorporated herein by reference, the current tempo, and hence the rate of advance (here, vertical drop) toward sounding zone 310 of visual cues for successive notes and/or chords, may slow in the example of FIG. 3B.

FIG. 3C illustrates near simultaneous sounding (by key strikes indicative of finger contacts by the user musician) of a pair of visually cued notes, one late and one early based on the current tempo. Visual indications 322 and 323 are indicative of such key strike gestures and will be understood to be captured and interpreted by the synthetic piano implementation as attempts by the user musician to sound notes corresponding to successive visually cued notes (see cues 305 and 306) presented on screen in accordance with a musical score and current tempo. Note that relative to current tempo, one of the captured note sounding gestures lags the expected sounding of the corresponding (and earlier in score-coded sequence) note visually cued as 305. Likewise, one of the captured note sounding gestures leads the expected sounding of the corresponding (and later in score-coded sequence) note visually cued as 306. Corresponding distances 312 and 313 (again, temporal distances or vertical on-screen distances normalizable thereto) by which the user musician's note soundings lag and lead expected sounding (based on current tempo and score coded meter) may be optionally processed by adaptive tempo algorithms such as described in the above-incorporated U.S. Patent and thereby affect the rate at which successive note cues are supplied and visually advanced.

Figure 4A:
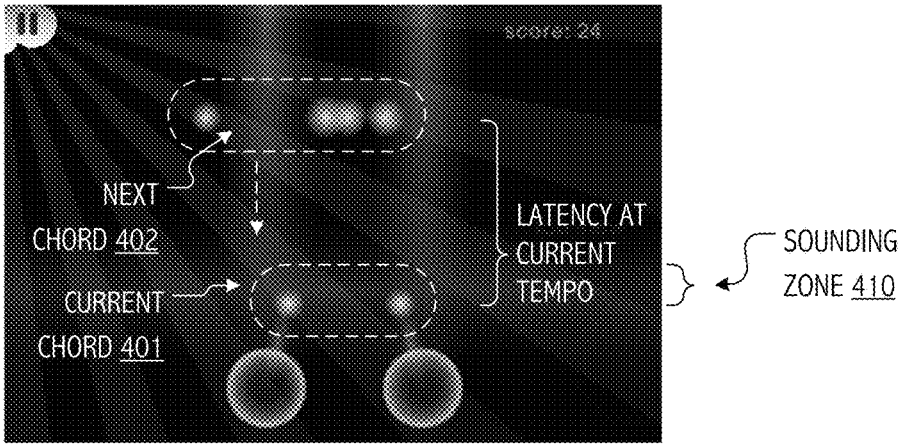
FIGS. 4A, 4B and 4C further illustrate spatio-temporal cuing aspects of a user interface design for a synthetic piano instrument in accordance with some embodiments of the present invention.
Figure 4B:
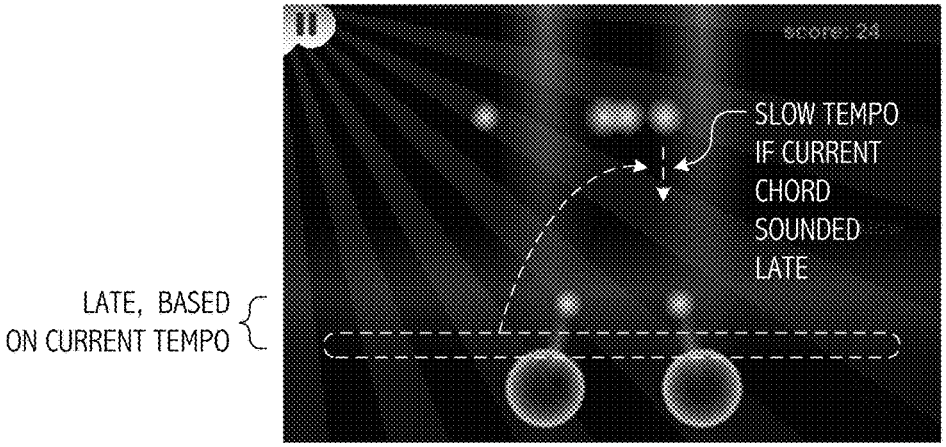
Figure 4C:
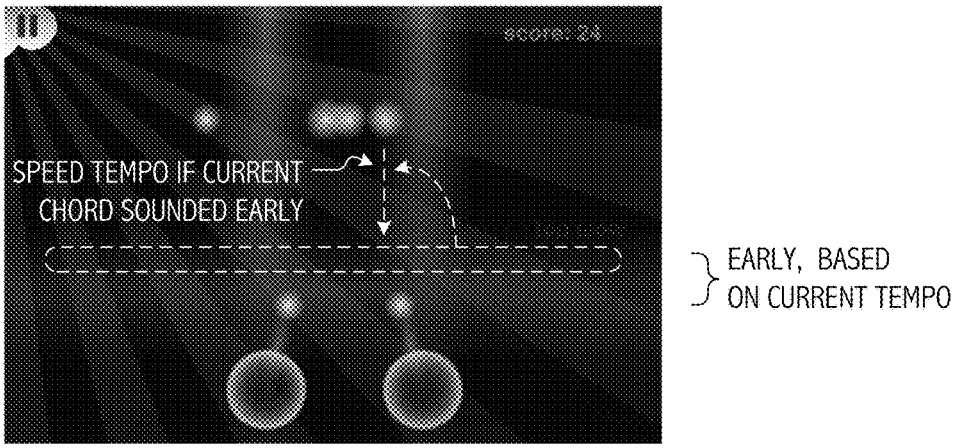

FIGS. 4A, 4B and 4C further illustrate spatio-temporal cuing aspects of a user interface design for a synthetic piano instrument in accordance with some embodiments of the present invention. As before, while temporal dynamics of the user interface are illustrative, adaptive tempo is optional. FIG. 4A illustrates a pair of temporally sequenced visual note cues (401, 402) indicating chords of notes to be sounded at a current target tempo and in correspondence with an underlying score. One of the visual note cues (401) is in a sounding zone 410, suggesting to the user musician that (based on the current target tempo) the notes of the corresponding current chord are to be sounded by a pair of simultaneous (or perhaps arpeggiated) finger contacts indicative of a key strikes. FIG. 4B illustrates possible late sounding (by key strikes indicative of finger contacts by the user musician) of the visually cued current chord. In accord with tempo recalculation techniques described herein, the current tempo, and hence the rate of advance (drop) toward a sounding zone of visual cues for successive chords and/or individual notes to be struck, may slow. FIG. 4C illustrates possible early sounding of the visually cued current chord. In accord with tempo recalculation techniques described in the above-incorporated U.S. Patent, the current tempo, and hence the rate of advance (drop) toward the sounding zone of visual cues for successive chords and/or individual notes to be struck, may increase. As before, distances (e.g., temporal distances or vertical on-screen distances normalizable thereto) by which the user musician's soundings of the visually cued chords lag (see FIG. 4B) or lead (see FIG. 4C) expected sounding (based on current tempo and score coded meter) are optionally processed by adaptive tempo algorithms and may affect the rate at which successive note cues are supplied and visually advanced.

Just as early and late sounding of cued notes are potentially expressive, so too can be finger contact dynamics that, in embodiments of a synthetic musical instrument implemented on a portable computing device capable of registering variations finger contact forces applied a multi-touch sensitive display. More specifically, measured or estimated magnitudes of finger contact forces applied in the course of the key strike gestures described above are captured as user expression of keyed note velocity and/or after-touch key pressure. Persons of skill in the art having benefit of the present disclosure will appreciate that, in certain embodiments, visual cuing symbologies such as that illustrated in FIGS. 3A, 3B, 3C, 4A, 4B and 4C may be extended to cue additional expressive aspects of a performance based on score-coded artifacts. For example, visual cues such as the note and/or chord cues illustrated and described above may be modified, augmented or extended to signify (e.g., by scaled size, color or some other visual indicator) gradations in the velocity (loudness/timbre) of the cued note and key striking force to be applied. Likewise, note and/or chord sounding visual cues such as those illustrated and described above may be modified, augmented or extended to signify (e.g., by a tail, elongate shape or some other visual indicator) variations in the sustain or after-touch key pressure to be applied in an expression of the cued note or chord. User interface features of FIGS. 3A, 3B, 3C, 4A, 4B and 4C as well as expressive finger contact dynamics (including measured/estimated keys strike forces and applied pressures) will therefore be understood in the context of such extended symbologies.

Figure 5:
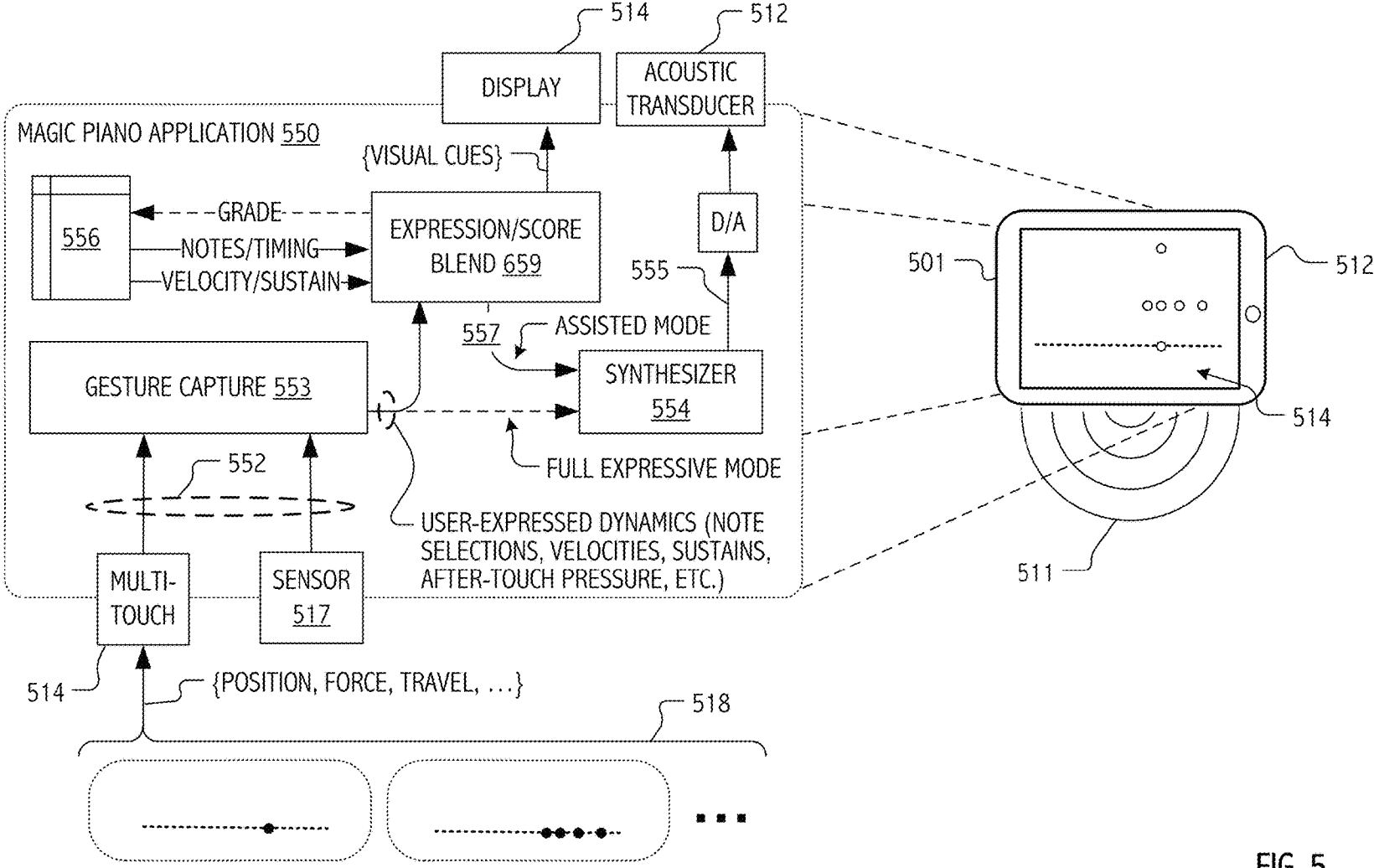
FIG. 5 is a functional block diagram that illustrates capture and encoding of user gestures corresponding to a sequence of note and chord soundings in a performance on a synthetic piano instrument, together with acoustic rendering of the performance in accordance with some embodiments of the present invention.

FIG. 5 is a functional block diagram that illustrates capture and encoding of user gestures corresponding to a sequence of note and chord soundings in a performance on a synthetic piano instrument (e.g., Magic Piano Application 550 executing on portable computing device 501), together with acoustic rendering of the performance in accordance with some embodiments of the present invention. Note sounding gestures 518 indicated by a user musician at touch screen/display 514 of portable computing device 501 are at least somewhat in correspondence with visually presented note cues on touch screen/display 514 and are, in turn, captured (553) and used to drive a digital synthesis (564) of acoustic response of a piano. Such visual cues (recall FIGS. 3A, 3B, 3C, 4A, 4B and 4C) are supplied in accordance with a musical score (notes, chords and meter) stored at least transiently in storage 556 and at a rate that is based on a current tempo that may be continuously adapted (659) based on the user's expressed performance and/or skill as described herein. For purposes of understanding suitable implementations, any of a wide range of digital synthesis techniques may be employed to drive audible rendering (511) of the user musician's performance via a speaker or other acoustic transducer (542) or interface thereto.

In general, the audible rendering can include synthesis of tones, overtones, harmonics, perturbations and amplitudes and other performance characteristics based on the captured gesture stream. In some cases, rendering of the performance includes audible rendering by converting to acoustic energy a signal synthesized from the gesture stream encoding (e.g., by driving a speaker). In some cases, the audible rendering is on the very device on which the musical performance is captured. In some cases, the gesture stream encoding is conveyed to a remote device whereupon audible rendering converts a synthesized signal to acoustic energy.

The digital synthesis (554) of a piano (or other keyboard-type percussion instrument) allows the user musician to control an actual expressive model using multi-sensor interactions (e.g., finger strikes at laterally coded note positions on screen, perhaps with sustenance or damping gestures expressed by particular finger travel or via a orientation- or accelerometer-type sensor 517) as inputs. In a portable computing device 501 embodiment that provides a force or pressure sensitive multi-touch sensitive display or which is configured to generate similar accelerometer-based data, key strike forces are captured as an additional component of user expression. Note that digital synthesis (554) is, at least for full synthesis modes, driven by the user musician's note sounding gestures, rather than by mere tap triggered release of the next score coded note. In this way, the user is actually causing the sound and controlling the timing, velocity, sustain, decay, pitch, quality and other characteristics of notes (including chords) sounded. A variety of computational techniques may be employed and will be appreciated by persons of ordinary skill in the art. For example, exemplary techniques include wavetable or FM synthesis.

Wavetable or FM synthesis is generally a computationally efficient and attractive digital synthesis implementation for piano-type musical instruments such as those described and used herein as primary teaching examples. However, and particularly for adaptations of the present techniques to syntheses of certain types of multi-string instruments (e.g., unfretted multi-string instruments such as violins, violas cellos and double bass), physical modeling may provide a livelier, more expressive synthesis that is responsive (in ways similar to physical analogs) to the continuous and expressively variable excitation of constituent strings. For a discussion of digital synthesis techniques that may be suitable in other synthetic instruments, see generally, commonly-owned U.S. Pat. No. 8,772,621, which is incorporated by reference herein.

Referring again to FIG. 5, and with emphasis on functionality of score expression blend block 659, the Magic Piano application 550 operates on user-expressed note selections, note velocities, note sustains, after-touch pressure, etc. captured (at gesture capture block 553) from a force/pressure magnitude responsive multi-touch sensitive display 514 and/or other sensor(s) 517. In a score-assisted mode of operation, score expression blend block 659 generates effective note sounding dynamics 557 (e.g., an effective note velocity based a linear or non-linear combination, blend or other composition of score-coded and user-expressed dynamics) and supplies same to synthesizer 554. In a full expressive mode of operation, user-expressed dynamics, e.g., note velocities, note sustains, after-touch pressure, etc. are supplied to synthesizer 554. In some embodiments, measured correspondence of a user musician's note sounding gestures with visual cues (e.g., timing, velocity, sustain, etc.) for notes or chords contributes to a grading or quality metric for the performance. In some embodiments, such grading or quality metric may be used in a competition or achievement posting facility of a gaming or social music framework.

In general, musical scores in storage 556 may be included with a distribution of the synthetic musical instrument or may be demand retrieved by a user via a communications interface as an "in-app" purchase. Generally, scores may be encoded in accord with any suitable coding scheme such as in accord with well-known musical instrument digital interface—(MIDI-) or open sound control—(OSC-) type standards, file/message formats and protocols (e.g., standard MIDI [.mid or .smf] formats, extensible music file, XMF formats; extensible MIDI [.xmi] formats; RIFF-based MIDI [.rmi] formats; extended RMID formats, etc.). Formats may be augmented or annotated to indicate operative windows for adaptive tempo management and/or musical phrase boundaries or key notes.

Performance Grading, Evaluation or Scoring

Figure 8:
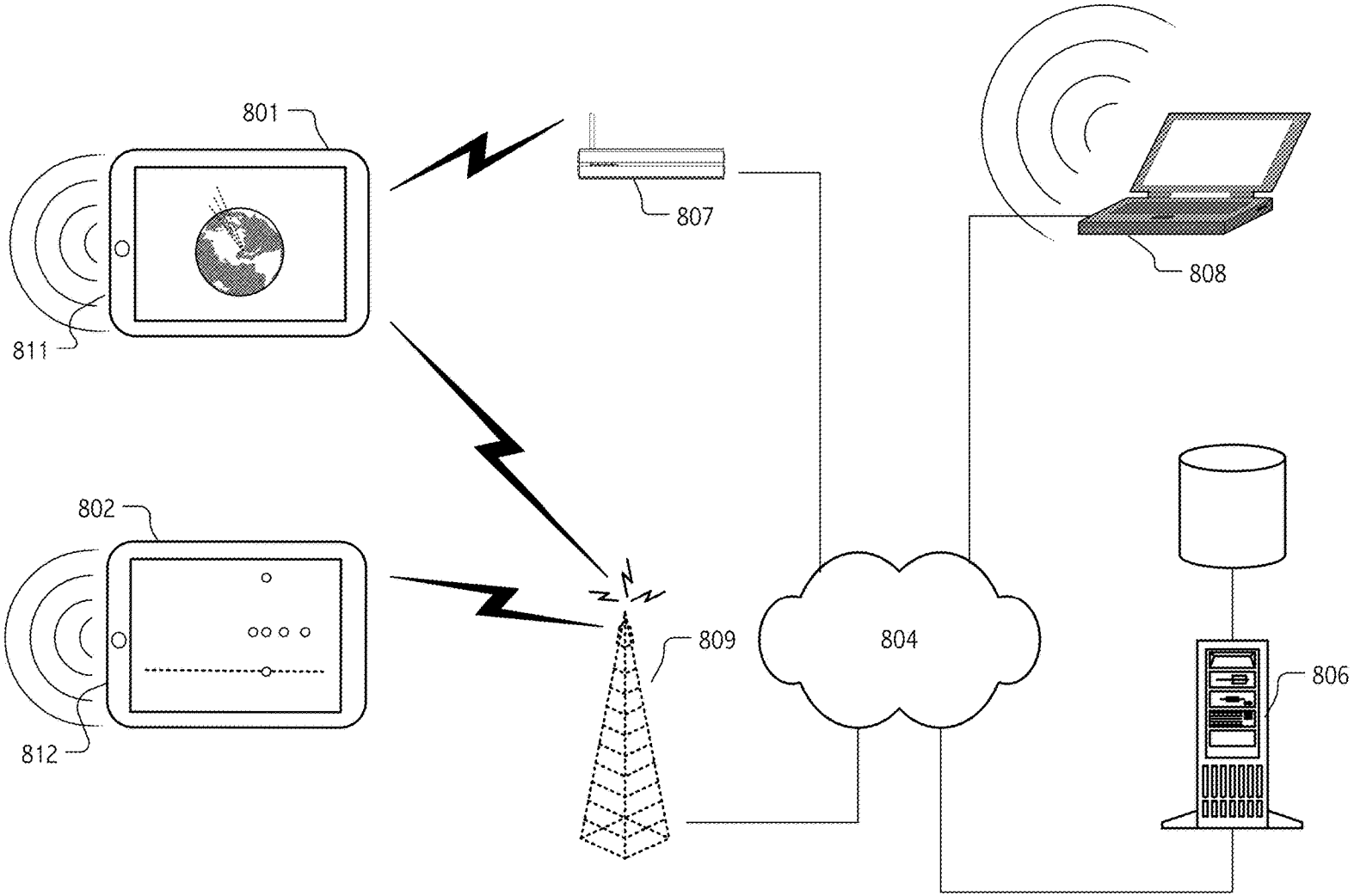
FIG. 8 is a network diagram that illustrates cooperation of exemplary devices in accordance with some embodiments of the present invention.

FIG. 8 is a functional block diagram that further illustrates, in addition to gesture capture, tempo variation and performance grading (previously described), optional communication of performance encodings and/or grades as part of a game play or competition framework, social network or content sharing facility in accordance with some embodiments of the present invention. In the synthetic piano implementations described herein, visual cues for musical score-coded notes and chords fall from the top of the user screen downward.

Figure 6:
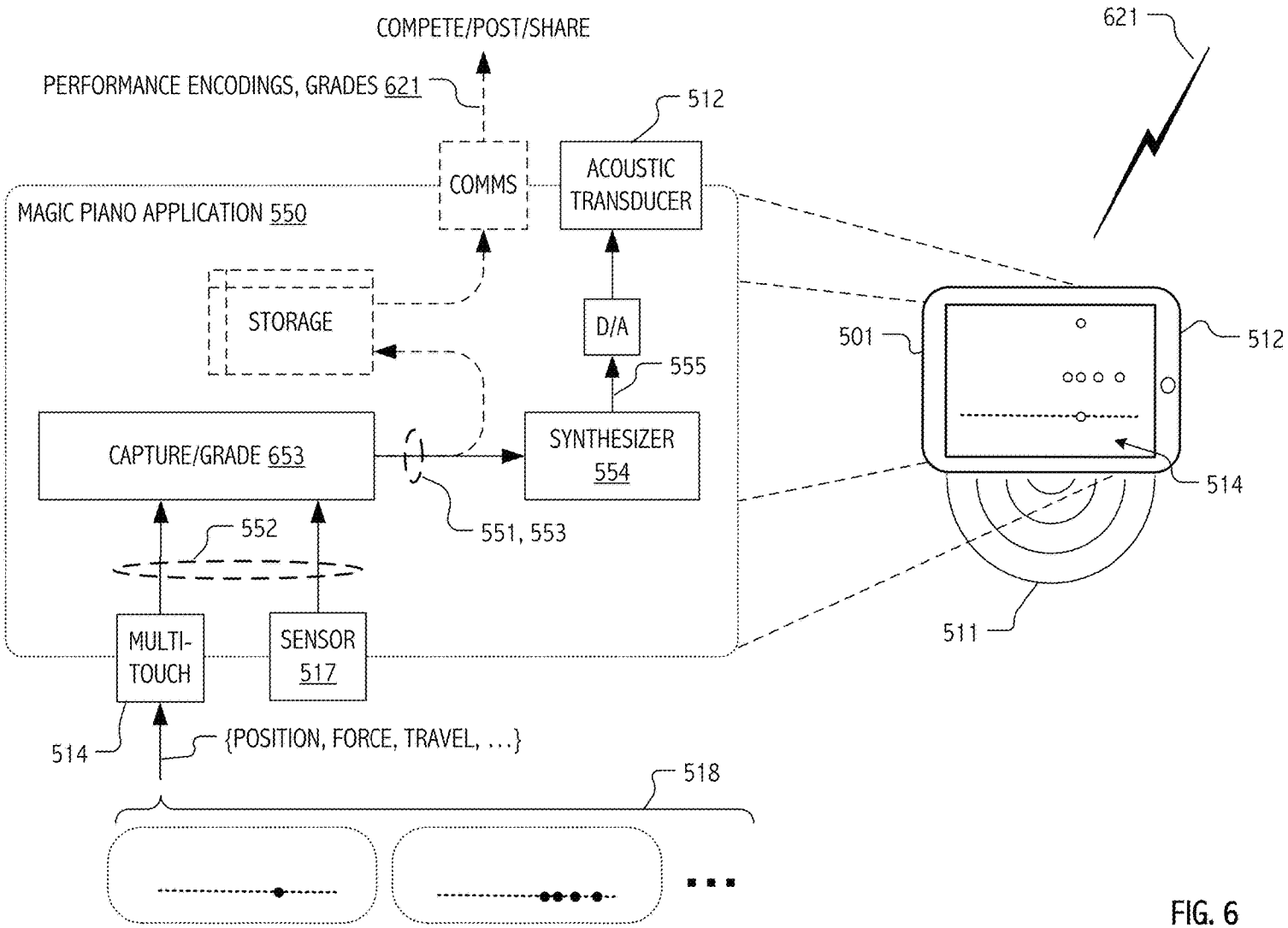
FIG. 6 is a functional block diagram that further illustrates, in addition to gesture capture, expression blending and performance grading (previously described), optional communication of performance encodings and/or grades as part of a game play or competition framework, social network or content sharing facility in accordance with some embodiments of the present invention.

Specifically, FIG. 6 illustrates (in a manner analogous to that described and explain above with reference to FIG. 5) the capture and encoding of user gestures corresponding to a sequence of note and chord soundings in a performance on a synthetic piano instrument (e.g., Magic Piano Application 550 executing on portable computing device 501), together with acoustic rendering of the performance in accordance with some embodiments of the present invention. As before, note sounding gestures 518 indicated by a user musician at touch screen/display 514 of portable computing device 501 are at least somewhat in correspondence with visually presented note cues on touch screen/display 514 and are, in turn, captured and used to drive a digital synthesis (564) of acoustic response of a piano.

In some embodiments and game-play modes, note soundings by a user-musician are "scored" or credited to a grade, if the selections, timings, velocities, and/or after-touch key pressures expressed in the form of captured note sounding gestures correspond to visually-cued aspects of the musical score. Thus, grading of a user's expressed performance (653) will be understood as follows:

A) with respect to individually cued notes, notes struck in horizontal (lateral) alignment with the horizontal screen position of the visual note cue (i.e., tap the screen on top of the note) are credited based on proper note selections, B) likewise with respect to individually cued notes, chords, and members of cued chords, applied finger contact forces are evaluated for at least relative correspondence with cued note velocities and after-touch key pressure, and B) with respect to both chords and individually cued notes, the notes (or constituent notes) struck between the time they vertically enter the horizontal highlighted scoring region (or sounding zone) and the time they leave the region are likewise credited (as in accord with a current tempo). Notes struck before or after the region are not credited, but may nonetheless contribute to a speeding up or slowing down of the current tempo in cases or embodiments that optionally provide adaptive tempo.

In this manner, songs that are longer and have more notes will yield potentially higher scores or at least the opportunity therefor. The music itself becomes a difficulty metric for the performance, some songs will be easier (and contain fewer notes, simpler sequences and pacings, etc.), while others will be harder (and may contain more notes, more difficult note/chord sequences, varied note velocities, after-touch key pressures, paces, etc.). Users can compete for top scores on a song-by-song basis so the variations in difficulty across songs are not a concern.

Expressiveness

A flexible performance grading system will generally allow users to create expressive musical performances. As will be appreciated by many a musician, successful and pleasing musical performances are generally not contingent upon performing to precisely-specified note velocities or to an absolute and strict single tempo. Instead, variations in expressed note velocities and tempo are commonly (and desirably) used as intentional musical artifacts by performers, emphasizing and deemphasizing certain notes, chords or members of a chord, embellishing with note sustains or variations after-touch key pressures, speeding up or slowing down phrases, etc. to add emphasis. These modulations in tempo (onsets and sustains) as well as note velocity and/or after-touch (or post-onset key pressure) can all contribute to "expressiveness." Accordingly, in synthetic piano implementations described herein, we aim to allow users to be expressive while remaining, generally speaking, rhythmically and otherwise consistent with musical score.

OTHER EMBODIMENTS

Figure 7:
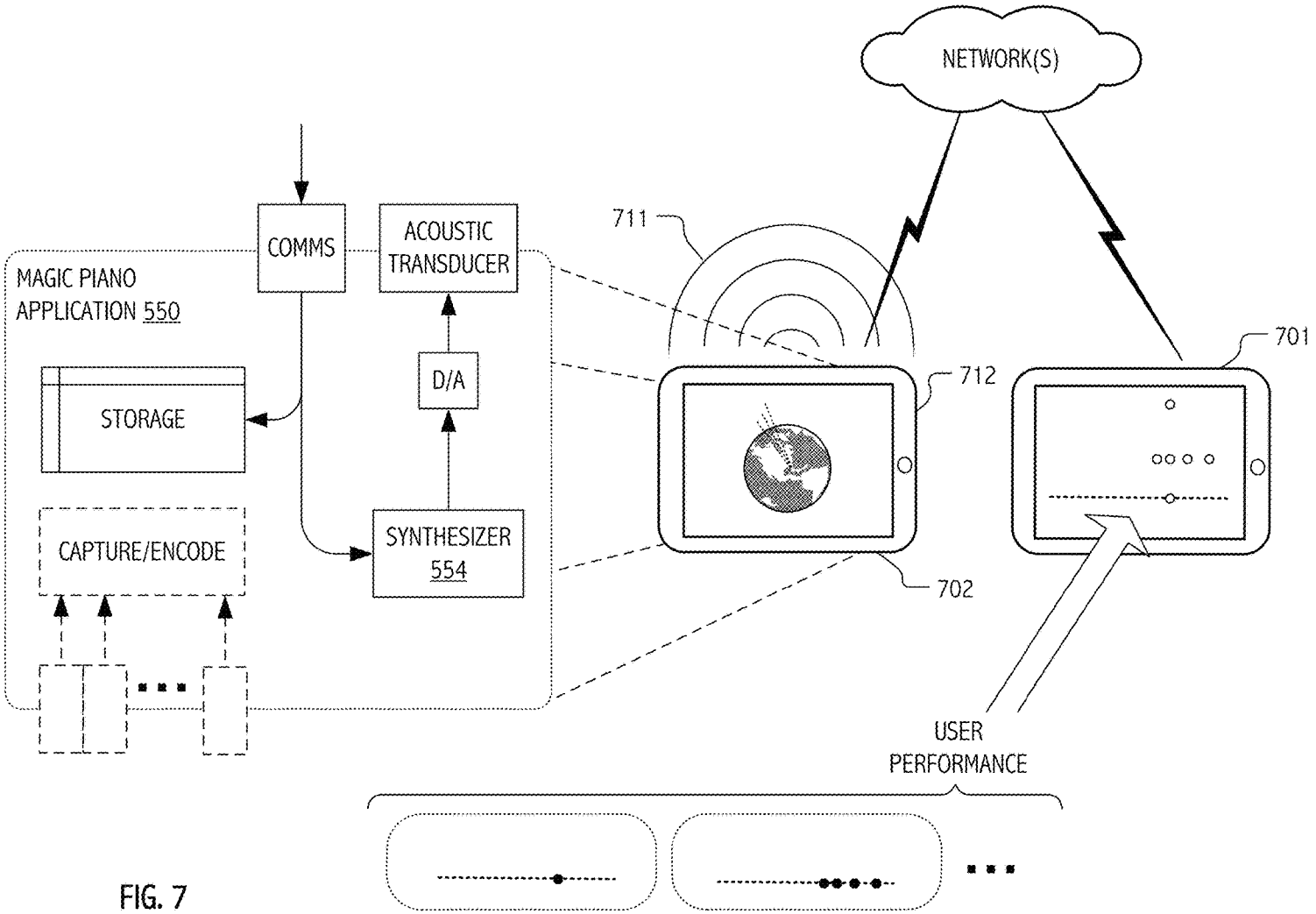
FIG. 7 is a functional block diagram that illustrates capture, encoding and transmission of a gesture stream (or other) encoding corresponding to a user performance on a synthetic piano instrument together with receipt of such encoding and acoustic rendering of the performance on a remote device.

FIG. 7 is a functional block diagram that illustrates capture, encoding and transmission of a gesture stream (or other) encoding corresponding to a user performance capture at a first instance 701 of a synthetic piano instrument together with receipt of such encoding and acoustic rendering (711) of the performance on a remote device 712 executing a second 702 of the piano instrument. FIG. 8 is a network diagram that illustrates cooperation of exemplary devices in accordance with some embodiments, uses or deployments of the present invention(s).

While the invention(s) is (are) described with reference to various embodiments, it will be understood that these embodiments are illustrative and that the scope of the invention(s) is not limited to them. Many variations, modifications, additions, and improvements are possible. For example, while a synthetic piano implementation has been used as an illustrative example, variations on the techniques described herein for other synthetic musical instruments such as string instruments (e.g., guitars, violins, etc.) and wind instruments (e.g., trombones) will be appreciated. Furthermore, while certain illustrative processing techniques have been described in the context of certain illustrative applications, persons of ordinary skill in the art will recognize that it is straightforward to modify the described techniques to accommodate other suitable signal processing techniques and effects.

Embodiments in accordance with the present invention may take the form of, and/or be provided as, a computer program product encoded in a machine-readable medium as instruction sequences and other functional constructs of software, which may in turn be executed in a computational system (such as a iPhone handheld, mobile device or portable computing device) to perform methods described herein. In general, a machine readable medium can include tangible articles that encode information in a form (e.g., as applications, source or object code, functionally descriptive information, etc.) readable by a machine (e.g., a computer, computational facilities of a mobile device or portable computing device, etc.) as well as tangible storage incident to transmission of the information. A machine-readable medium may include, but is not limited to, magnetic storage medium (e.g., disks and/or tape storage); optical storage medium (e.g., CD-ROM, DVD, etc.); magneto-optical storage medium; read only memory (ROM); random access memory (RAM); erasable programmable memory (e.g., EPROM and EEPROM); flash memory; or other types of medium suitable for storing electronic instructions, operation sequences, functionally descriptive information encodings, etc.

In general, plural instances may be provided for components, operations or structures described herein as a single instance. Boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the invention(s).

What is claimed is:

1. A method comprising:

using a portable computing device as a synthetic musical instrument;

presenting a user of the synthetic musical instrument with visual cues on a multi-touch sensitive display of the portable computing device, the presented visual cues indicative of temporally sequenced note selections in accord with a musical score;

capturing note sounding gestures indicated by the user based on finger contacts with the multi-touch sensitive display, wherein individual ones of the captured note sounding gestures are characterized, at least in part, based on position and dynamics of finger contact with the multi-touch sensitive display; and audibly rendering a performance on the portable computing device in real-time correspondence with the captured note sounding gestures, including the finger contact dynamics thereof.

2. The method of claim 1, wherein the finger contact dynamics include a characterization of finger contact force applied to the multi-touch sensitive display; and wherein the characterization of finger contact force is used as at least a contributing indicator for velocity with which a corresponding note is sounded in the audibly rendered performance.

3. The method of claim 2, further comprising:

for member notes of a chord sounded in the audibly rendered performance, applying a generally uniform velocity based on the characterization of at least one corresponding finger contact force.

4. The method of claim 2, further comprising:

for member notes of a chord sounded in the audibly rendered performance, applying individual velocities based, at least in part, on characterizations of respective finger contact forces.

5. The method of claim 2, wherein the finger contact force is characterized at the portable computing device based on sensitivity of the multi-touch sensitive display itself to a range of applied force magnitudes.

6. The method of claim 5, wherein the characterization of finger contact force includes a remapping from a multi-touch sensitive display contact force data domain to a mapped range of note velocities for the synthetic musical instrument.

7. The method of claim 6, wherein the synthetic musical instrument includes a piano or keyboard; and wherein the remapping is in accord with a normalized half-sigmoidal-type mapping function.

8. The method of claim 2, wherein the finger contact force is characterized at the portable computing device based on accelerometer data associable with the finger contact.

9. The method of claim 2, wherein the finger contact dynamics further include both onset and release of a finger contact; and wherein a temporal extent of the finger contact, from onset to release, is used as at least a contributing indicator for sustaining of a corresponding note sounded in the audibly rendered performance.

10. The method of claim 2, wherein the finger contact dynamics further include after-touch dynamics used as at least for vibrato or bend of a corresponding note sounded in the audibly rendered performance.

11. The method of claim 1, wherein the musical score encodes a temporal sequencing of note selections together with corresponding dynamics, the method further comprising:

for at least a subset of the captured note sounding gestures, computing effective note sounding dynamics based, for a given note sounding gesture, on both:

the score-coded dynamics for the corresponding note selection; and user-expressed dynamics of finger contact with the multi-touch sensitive display; and audibly rendering the performance on the portable computing device in real-time correspondence with the captured note sounding gestures based on the computed effective note sounding dynamics.

12. The method of claim 11, further comprising:

computing the effective note sounding dynamics as a function that includes a weighed sum of the score-coded and user-expressed dynamics.

13. The method of claim 12, wherein the weighed sum includes an approximately 25% contribution in accord with score-coded note velocities and an approximately 75% contribution in accord user-expressed note sounding velocity characterized based on finger contact forces applied to the multi-touch sensitive display.

14. The method of claim 11, further comprising:

varying comparative contributions of score-coded dynamics and user-expressed dynamics to the computed effective note sounding dynamics based on a user interface control.

15. The method of claim 14, wherein the user interface control is provided at least in part, using a slider, knob or selector visually presented on the multi-touch sensitive display; and wherein the user interface control provides either or both of:

a predetermined set of values for the comparative contributions and an effectively continuous variation of the comparative contributions.

16. The method of claim 14, further comprising:

dynamically varying the comparative contributions.

17. The method of claim 11, further comprising:

based on the musical score, dynamically varying during a course of the performance comparative contributions of score-coded dynamics and user-expressed dynamics to the computed effective note sounding dynamics.

18. The method of claim 11, further comprising:

computing the effective note sounding dynamics as a function that modulates score-coded note velocities based on characterization of user-expressed finger contact forces applied to the multi-touch sensitive display in connection with the particular note sounding gestures.

19. The method of claim 1, further comprising:

determining correspondence of respective captured note sounding gestures with the visual cues; and grading the user's performance based on the determined correspondences.

20. The method of claim 19, further comprising:

presenting the user with visual cues indicative of score-coded note velocities, wherein the determined correspondences include correspondence of score-coded note velocities with note velocities actually expressed by the users note sounding gestures.

21. The method of claim 19, wherein the determined correspondences include a measure of correspondence of finger contact dynamics for particular note sounding gesture with visually cued note velocity.

22. The method of claim 1, wherein the presented visual cues traverse at least a portion of the multi-touch sensitive display toward a sounding zone.

23. The method of claim 1, wherein the synthetic musical instrument is a piano or keyboard, and wherein the visual cues travel across the multi-touch sensitive display and represent, in one dimension of the multi-touch sensitive display, desired key contacts in accordance with notes of the score and, in a second dimension generally orthogonal to the first, temporal sequencing of the desired key contacts.

24. The method of claim 1, wherein the synthetic musical instrument is a string instrument, and wherein the visual cues code, in one dimension of the multi-touch sensitive display, desired contact with corresponding ones of the strings in accordance with the score and, in a second dimension generally orthogonal to the first, temporal sequencing of the desired contacts paced in accord with the current value of the target tempo.

25. The method of claim 24, wherein the captured note sounding gestures are indicative of both string excitation and pitch selection for the excited string.

26. The method of claim 19, further comprising:

presenting on the multi-touch sensitive display a lesson plan of exercises, wherein the captured note selection gestures correspond to performance by the user of a particular one of the exercises; and advancing the user to a next exercise of the lesson plan based on a grading of the user's performance of the particular exercise.

27. The method of claim 1, wherein the portable computing device includes a communications interface, the method further comprising, transmitting an encoded stream of the note sounding gestures via the communications interface for rendering of the performance on a remote device.

28. The method of claim 1, wherein the audible rendering includes:

modeling acoustic response for one of a piano, a guitar, a violin, a viola, a cello and a double bass; and driving the modeled acoustic response with inputs corresponding to the captured note sounding gestures and, for at least some of the captured note sounding gestures, a combination of score-coded and user-expressed dynamics.

29. The method of claim 1, wherein the portable computing device is selected from the group of:

a compute pad;

a personal digital assistant or book reader; and a mobile phone or media player.

30. The method of claim 27, further comprising:

geocoding the transmitted gesture stream; and displaying a geographic origin for, and in correspondence with audible rendering of, another user's performance encoded as another stream of notes sounding gestures received via the communications interface directly or indirectly from a remote device.

31. An apparatus comprising:

a portable computing device having a multi-touch display interface; and machine readable code executable on the portable computing device to implement the synthetic musical instrument, the machine readable code including instructions executable to present a user of the synthetic musical instrument with visual cues on a multi-touch sensitive display of the portable computing device, the presented visual cues indicative of temporally sequenced note selections in accord with a musical score, wherein the musical score further encodes dynamics for at least some of the note selections; and the machine readable code further executable to (i) capture note sounding gestures indicated by the user based on finger contacts with the multi-touch sensitive display, wherein individual ones of the captured note sounding gestures are characterized, at least in part, based on position and dynamics of finger contact with the multi-touch sensitive display and (ii) for at least a subset of the captured note sounding gestures, to compute effective note sounding dynamics based, for a given note sounding gesture, on both the score-coded dynamics for the corresponding note selection and user-expressed dynamics of finger contact with the multi-touch sensitive display.

32. The apparatus of claim 31, further comprising:

machine readable code executable on the portable computing device to audibly render the performance on the portable computing device in real-time correspondence with the captured note sounding gestures based on the computed effective note sounding dynamics.

33. The apparatus of claim 31, embodied as one or more of a compute pad, a handheld mobile device, a mobile phone, a personal digital assistant, a smart phone, a media player and a book reader.

34. A computer program product encoded in media and including instructions executable to implement a synthetic musical instrument on a portable computing device having a multi-touch display interface, the computer program product encoding and comprising:

instructions executable on the portable computing device to present a user of the synthetic musical instrument with visual cues on the multi-touch sensitive display of the portable computing device, the presented visual cues indicative of temporally sequenced note selections in accord with a musical score, wherein the musical score further encodes dynamics for at least some of the note selections; and instructions executable on the portable computing device to (i) capture note sounding gestures indicated by the user based on finger contacts with the multi-touch sensitive display, wherein individual ones of the captured note sounding gestures are characterized, at least in part, based on position and dynamics of finger contact with the multi-touch sensitive display and (ii) for at least a subset of the captured note sounding gestures, to compute effective note sounding dynamics based, for a given note sounding gesture, on both the score-coded dynamics for the corresponding note selection and user-expressed dynamics of finger contact with the multi-touch sensitive display.

35. The computer program product of claim 31, further encoding and comprising:

instructions executable on the portable computing device to audibly render the performance on the portable computing device in real-time correspondence with the captured note sounding gestures based on the computed effective note sounding dynamics.

36. The computer program product of claim 31, wherein the media are readable by the portable computing device or readable incident to a computer program product conveying transmission to the portable computing device.

* * * * *